US010020588B2

(12) United States Patent
Kim et al.

(10) Patent No.: US 10,020,588 B2
(45) Date of Patent: Jul. 10, 2018

(54) ANTENNA DEVICE AND METHOD FOR MANUFACTURING SAME

(71) Applicant: GWANGJU INSTITUTE OF SCIENCE AND TECHNOLOGY, Gwangju (KR)

(72) Inventors: Kang-Wook Kim, Gwangju (KR); Woong Kang, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 77 days.

(21) Appl. No.: 14/888,703

(22) PCT Filed: Dec. 30, 2013

(86) PCT No.: PCT/KR2013/012400

§ 371 (c)(1),
(2) Date: Nov. 2, 2015

(87) PCT Pub. No.: WO2014/185617

PCT Pub. Date: Nov. 20, 2014

(65) Prior Publication Data

US 2016/0087341 A1 Mar. 24, 2016

(30) Foreign Application Priority Data

May 14, 2013 (KR) ..... 10-2013-0054161

(51) Int. Cl.
*H01Q 13/10* (2006.01)
*H01Q 9/44* (2006.01)
*H01Q 13/08* (2006.01)

(52) U.S. Cl.
CPC ..... *H01Q 13/10* (2013.01); *H01Q 9/44* (2013.01); *H01Q 13/085* (2013.01); *H01Q 13/103* (2013.01)

(58) Field of Classification Search
CPC .. H01Q 1/22–1/245; H01Q 1/38; H01Q 1/50; H01Q 13/10; H01Q 13/103;
(Continued)

(56) References Cited

U.S. PATENT DOCUMENTS 7,609,219 B2 * 10/2009 Hashimoto ..... H01Q 13/10 343/767
2010/0176998 A1 7/2010 Sorvala

FOREIGN PATENT DOCUMENTS

JP 2007060127 A 3/2007
KR 1019900004062 A 3/1990
(Continued)

OTHER PUBLICATIONS

International Search Report for PCT/KR2013/012400 dated Apr. 16, 2014.

*Primary Examiner* — Tho G Phan
*Assistant Examiner* — Patrick Holecek
(74) *Attorney, Agent, or Firm* — Hauptman Ham, LLP

(57) ABSTRACT

An antenna device is provided, which includes a ground plate formed of a conductor for ground to perform ground function, and a slot formed with specific width and length and positioned on an upper portion of the ground plate, wherein the slot includes a feeding portion configured to receive a signal for feeding, and a plurality of chip resistors positioned apart from the feeding portion for a predetermined distance in a direction that crosses the width of the slot. Accordingly, an electromagnetic signal that is radiated by radar and then is reflected from points excluding a target can be effectively intercepted and thus the system performance can be improved.

7 Claims, 8 Drawing Sheets

(58) Field of Classification Search
CPC .... H01Q 13/106; H01Q 13/18; H01Q 13/085;
H01Q 9/44
See application file for complete search history.

(56) References Cited

FOREIGN PATENT DOCUMENTS

| | | | |
|---|---|---|---|
| KR | 1020020056960 | A | 7/2002 |
| KR | 1020040077052 | A | 9/2004 |
| KR | 1020050084169 | A | 8/2005 |
| KR | 100562952 | B1 | 3/2006 |
| KR | 1020070071589 | A | 7/2007 |

* cited by examiner

ANTENNA DEVICE AND METHOD FOR MANUFACTURING SAME

TECHNICAL FIELD

The present disclosure relates to an antenna device and a method for manufacturing the same.

BACKGROUND ART

Radar (Radio detection and ranging) is to find the existence of a target using an electromagnetic signal that is radiated to and then is reflected from the target. As radio waves used in the radar, microwaves having a wavelength of 30 cm or less may be used. The reason why the microwaves having the wavelength of 30 cm or less is used in the radar is that as the wavelength becomes shorter, linearity, directivity, and sensitivity of the radar become better.

Antennas used in the radar may include a Vivaldi antenna, an LP (Log Periodic) antenna, an IR (Impulse Radiation) antenna, a TMP (Transverse Electro Magnetic) horn antenna, and a resistive dipole antenna. The antennas used in the radar have common features. The antenna used in the radar has a low center frequency, and thus superior penetration performance can be obtained through a medium. Further, the antenna used in the radar operates in a wide bandwidth, and thus it is possible to obtain a high-resolution image.

Among the antennas as described above, the resistive dipole antenna has a small volume, and thus high-density arrangement becomes possible. In addition, since the resistive dipole antenna has the advantage that it can radiate ultra wideband signal with low distortion in the time domain, it has been actively used in the radar. However, its backward radiation and reception possibility still causes a problem.

In the rear of the antenna device, system hardware or an operator usually exists, and the electromagnetic signal that is radiated by the radar and then is reflected from such system hardware or operator acts as clutter to limit the performance of the radar system. In order to solve this problem, a metal reflective plate or a microwave absorber may be installed in the rear of the antenna device.

However, the metal reflective plate may change the waveform of the electromagnetic signal that is radiated by the radar and then is reflected from the target to change the antenna characteristic, and the microwave absorber may cause a problem in implementing the system due to its large volume.

DISCLOSURE

Technical Problem

The present disclosure has been made to solve the above-mentioned problems occurring in the prior art while advantages achieved by the prior art are maintained intact.

One subject to be achieved by the present disclosure is to provide an antenna device and a method for manufacturing the same, which can effectively intercept an electromagnetic signal that is radiated by radar and then is reflected from points excluding a target to improve the system performance.

Another subject to be achieved by the present disclosure is to provide an antenna device and a method for manufacturing the same, which can eliminate a reflected signal inside the antenna excluding a feeding portion with the lapse of time through weakening of the power of the signal through a plurality of chip resistors in a slot, and thus can obtain the time domain characteristic that is suitable to sensing.

The subjects to be achieved by the present disclosure are not limited to those as described above, but may be clearly understood by a person of ordinary skill in the art from the following description.

Technical Solution

In one aspect of the present disclosure, there is provided an antenna device, which includes a ground plate formed of a conductor for ground to perform ground function; and a slot formed with specific width and length and positioned on an upper portion of the ground plate, wherein the slot includes a feeding portion configured to receive a signal for feeding, and a plurality of chip resistors positioned apart from the feeding portion for a predetermined distance in a direction that crosses the width of the slot.

Each of the plurality of chip resistors may have any one of a resistance value determined according to the position of the slot, a predetermined resistance value, and a resistance value determined according to an arrangement structure of the antenna device.

The predetermined distance may be determined in accordance with a resonance frequency according to specifications of the antenna device.

The predetermined distance may be determined in accordance with the result of comparison of a resonance frequency generated between the feeding portion and the plurality of chip resistors with a resonance frequency according to the specifications of the antenna device.

The predetermined distance may be determined so that the resonance frequency generated between the feeding portion and the plurality of chip resistors becomes higher than the resonance frequency according to the specifications of the antenna device through comparison of the resonance frequencies with each other.

Each of the plurality of chip resistors may consume the power of the signal if the signal for feeding is applied to the feeding portion.

The ground plate may have an absorption rate and an absorption loss rate according to specifications of the antenna device.

In another aspect of the present disclosure, there is provided a method for manufacturing an antenna device, which includes forming a ground plate formed of a conductor for ground to perform ground function; and forming a slot formed with specific width and length on an upper portion of the ground plate, wherein the slot includes a feeding portion configured to receive a signal for feeding, and a plurality of chip resistors positioned apart from the feeding portion for a predetermined distance in a direction that crosses the width of the slot.

Each of the plurality of chip resistors may have any one of a resistance value determined according to the position of the slot, a predetermined resistance value, and a resistance value determined according to an arrangement structure of the antenna device.

The method for manufacturing an antenna device according to the aspect of the present disclosure may further include forming the plurality of chip resistors at predetermined intervals in accordance with a resonance frequency according to specifications of the antenna device.

The method for manufacturing an antenna device according to the aspect of the present disclosure may further include forming the plurality of chip resistors at predetermined intervals in accordance with the result of comparison of a resonance frequency generated between the feeding portion and the plurality of chip resistors with a resonance frequency according to the specifications of the antenna device.

The method for manufacturing an antenna device according to the aspect of the present disclosure may further include forming the plurality of chip resistors at predetermined intervals so that the resonance frequency generated between the feeding portion and the plurality of chip resistors becomes higher than the resonance frequency according to the specifications of the antenna device.

Each of the plurality of chip resistors may consume the power of the signal if the signal for feeding is applied to the feeding portion.

The ground plate may have an absorption rate and an absorption loss rate according to specifications of the antenna device.

Advantageous Effect

According to the present disclosure, since the electromagnetic signal that is radiated by the radar and then is reflected from the points excluding the target can be effectively intercepted, the system performance can be improved.

Further, since the reflected signal inside the antenna excluding the feeding portion does not exist with the lapse of time through weakening of the power of the signal through the plurality of chip resistors in the slot, it becomes possible to provide the time domain characteristic that is suitable to sensing.

BRIEF DESCRIPTION OF THE DRAWINGS

The above objects, other features and advantages of the present disclosure will become more apparent by describing the preferred embodiments thereof with reference to the accompanying drawings, in which.

PREFERRED EMBODIMENTS OF THE INVENTION

Figure 1:
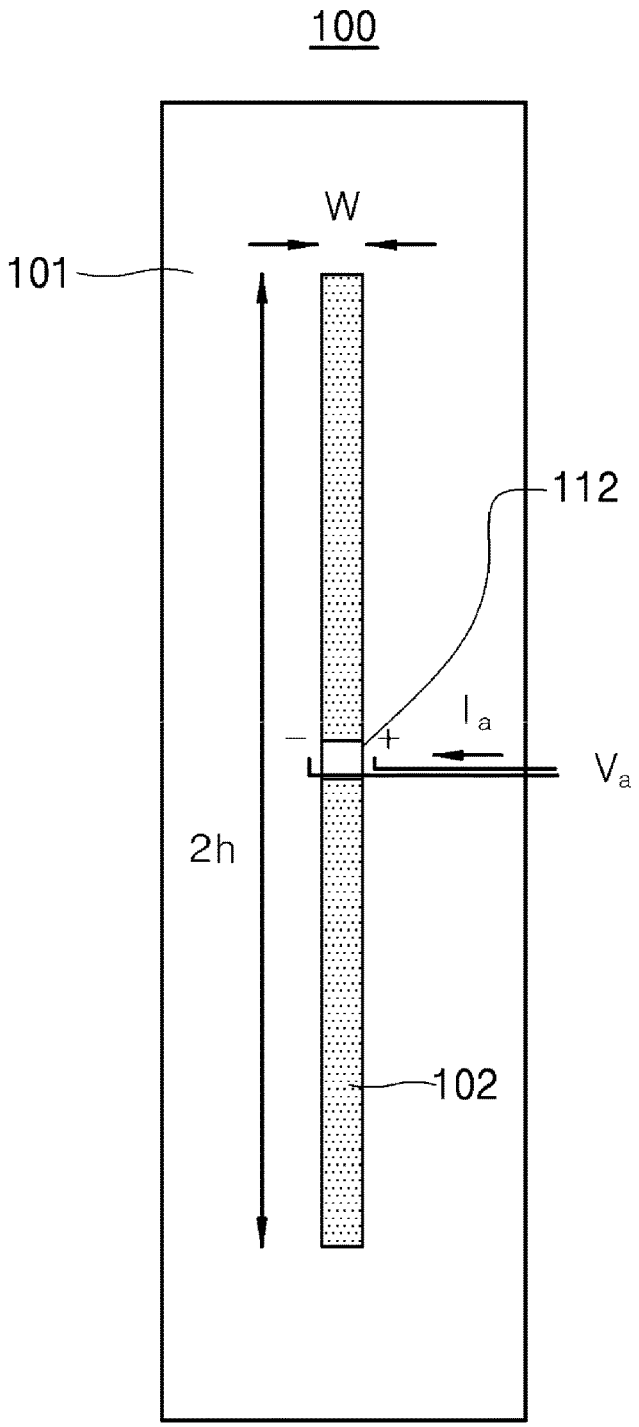
FIG. 1 is a view explaining an antenna device according to an embodiment of the present disclosure.

Hereinafter, preferred embodiments of the present disclosure will be described with reference to the accompanying drawings. The advantages and/or features of the present disclosure, and a method for achieving them will become apparent to those having ordinary skill in the art upon examination of the embodiments described hereinafter. However, it should be understood that the present disclosure is not limited to the specific embodiments described hereinafter, but includes various modifications, equivalents, and/or alternatives of the embodiments of the present disclosure, and thus should be defined by the scope of the appended claims. In relation to explanation of the drawings, the same drawing reference numerals may be used for the same constituent elements.

Figure 2:
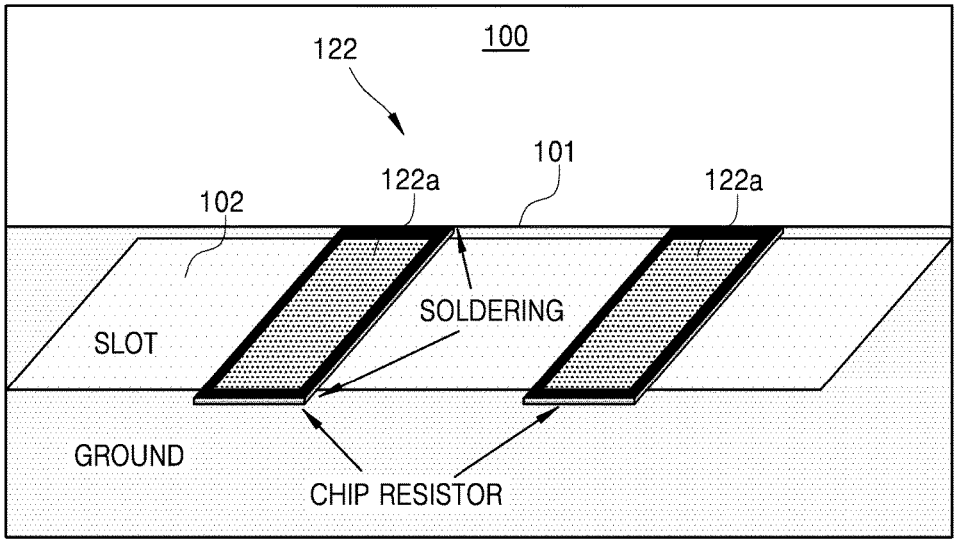
FIG. 2 is a view explaining an internal structure of a slot in FIG. 1.

FIG. 1 is a view explaining an antenna device according to an embodiment of the present disclosure, and FIG. 2 is a view explaining an internal structure of a slot in FIG. 1.

Referring to FIGS. 1 and 2, an antenna device 100 includes a ground plate 101 having a predetermined dielectric constant and a predetermined thickness, and a slot 102 having a length that is ½ of a center frequency wavelength $\lambda$ for radiation of an electromagnetic field.

The ground plate 101 is formed of a conductor for ground and performs ground function. The ground plate 101 may have an absorption rate and an absorption loss rate according to the specifications of the antenna device 100. Accordingly, the ground plate 101 can effectively intercept an electromagnetic signal that is radiated by radar and then is reflected from points excluding a target, and thus the system performance can be improved.

The ground plate 101 may include a feeding line (not illustrated) for feeding electromagnetic field energy to the slot 102.

The slot 102 is formed with specific width and length and is positioned on an upper portion of the ground plate 101. The slot 102 is loaded by a resistance component. In an embodiment, the slot 102 may be in a rectangular shape having a narrow or wide width or may be in a circular shape.

The slot 102 may include a plurality of chip resistors 122 and a feeding portion 112.

The feeding portion 110 may receive a specific pulse signal. In an embodiment, the feeding portion 110 may receive a short pulse signal.

If a signal for feeding of the slot 102 is applied through the feeding line of the ground plate 101, the feeding portion 112 moves to both end portions of a slot arm, and the antenna device 100 radiates a signal to a target and finds the existence of the target using the signal that is reflected from the target.

The power of the signal that is applied to the feeding portion 112 is consumed by the plurality of chip resistors 122, and with the lapse of time, the power of the signal is weakened at the both end portions of the arm of the slot 102 to cause the reflected signal in the antenna to be eliminated.

The plurality of chip resistors 122 may be positioned apart from the feeding portion 112 for a predetermined distance in a direction that crosses the width of the slot 102.

In an embodiment, each of the plurality of chip resistors 122 may be positioned apart from the feeding portion 112 for the predetermined distance in accordance with the result of comparison of a resonance frequency generated between the feeding portion 112 and the plurality of chip resistors 122 with a resonance frequency according to the specifications of the antenna device 100. In an embodiment, each of the plurality of chip resistors 122 may be positioned apart from the feeding portion 112 for the predetermined distance so that the resonance frequency generated between the feeding portion 112 and the plurality of chip resistors 122 becomes higher than the resonance frequency according to the specifications of the antenna device 100.

The plurality of chip resistors 122 may have different resistance values.

In an embodiment, the plurality of chip resistors 122 may have different resistance values according to the position of the slot 102. In another embodiment, the plurality of chip resistors 122 may have predetermined resistance values. Instill another embodiment, the plurality of chip resistors 122 may have different resistance values according to the arrangement structure of the antenna device 100.

The plurality of chip resistors 122 consume the power of the signal that is applied to the feeding portion 112 to weaken the power of the signal.

Figure 3:
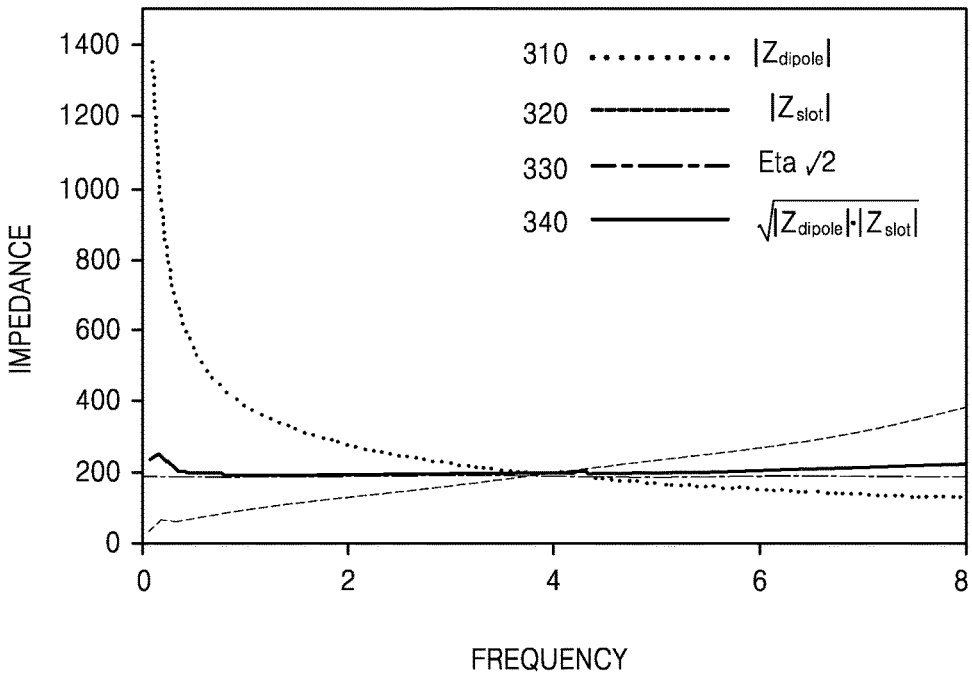
FIG. 3 is a graph showing a complementary relation between the antenna device of FIG. 1 and a dipole antenna.

FIG. 3 is a graph showing a complementary relation between the antenna device of FIG. 1 and a dipole antenna.

Referring to FIG. 3, input impedance of the antenna device 100 according to the present disclosure and input impedance of a general resistive dipole antenna may have a complementary relation. In the graph of FIG. 3, X-axis represents frequency, and Y-axis represents impedance.

The reference numeral "310" denotes input impedance of the resistive dipole antenna, and the reference numeral "320" denotes input impedance of the antenna device 100 according to the present disclosure. The reference numeral "330" denotes a Booker's relation that is calculated by Equation 1 and Equation 2 below, and the reference numeral "340" denotes a relation between the input impedance of the resistive dipole antenna and the input impedance of the antenna device 100 according to the present disclosure that is calculated by Equation 1 and Equation 2 below.

In general, the dipole and the slot satisfy the Booker's relation at frequencies. As shown in FIG. 3, the antenna device 100 according to the present disclosure and the resistive dipole antenna satisfy the Booker's relation through a broadband, and thus the antenna device 100 according to the present disclosure and the resistive dipole antenna have a complementary structure.

$$Z_{dipole} S\ Z_{slot} = (\mathrm{Eta})^2/4 \quad \text{[Equation 1]}$$

$Z_{dipole}$: Input impedance of resistive dipole antenna $Z_{slot}$: Input impedance of antenna device according to the present disclosure Eta: Impedance acting on propagation of electromagnetic waves in free space $$\sqrt{Z_{dipole} S Z_{slot}} = (\mathrm{Eta}/2) \quad \text{[Equation 2]}$$

$Z_{dipole}$: Input impedance of resistive dipole antenna $Z_{slot}$: Input impedance of antenna device according to the present disclosure Eta: Impedance acting on propagation of electromagnetic waves in free space Equation 2 can be calculated on the basis of Equation 1.

Figure 4:
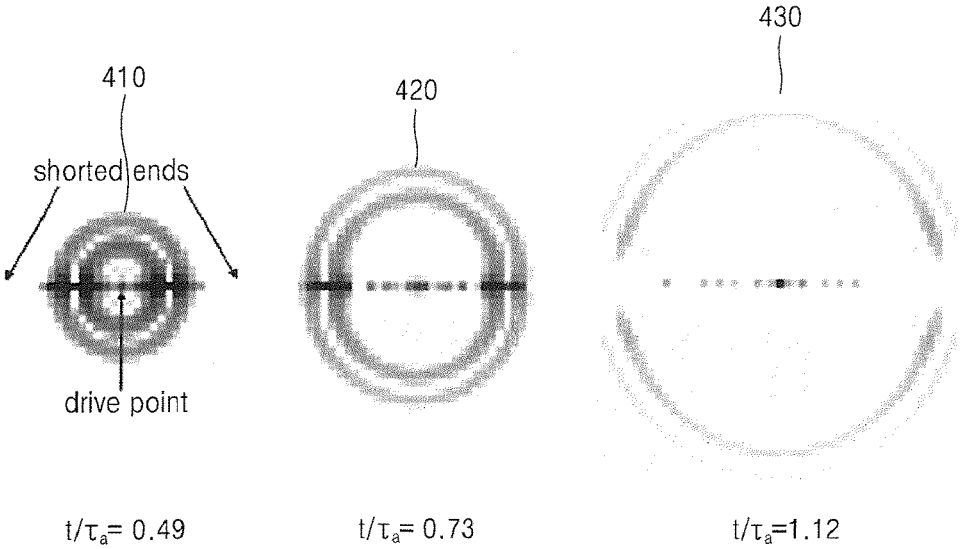
FIGS. 4 and 5 are views explaining the temporal changes of radiation amounts of the antenna device of FIG. 1 and a general antenna device that operates in a resonance mode.
Figure 5:
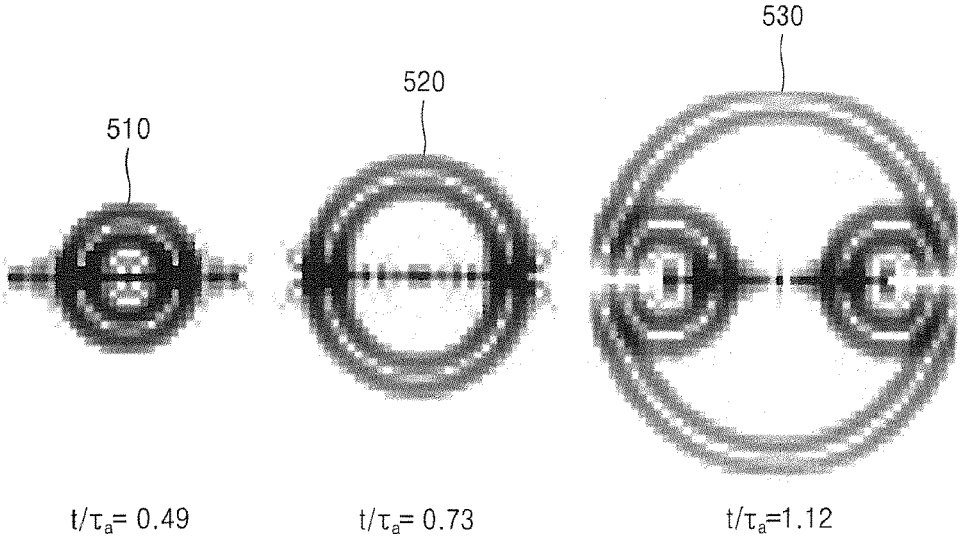
Figure 6:
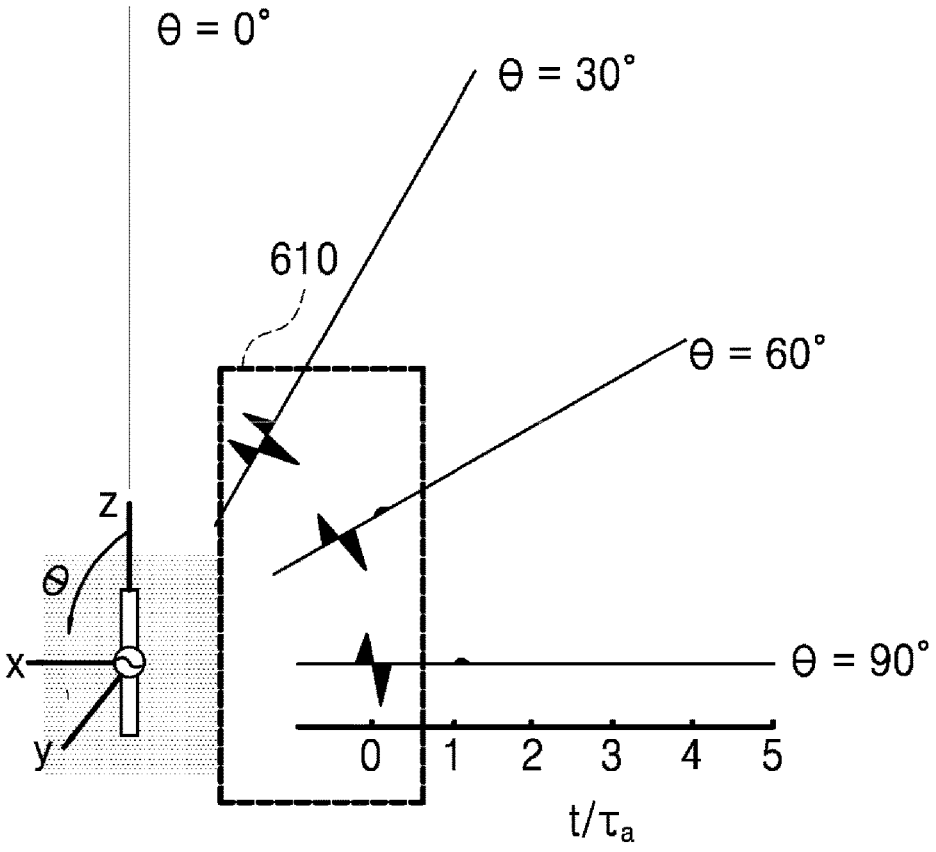
FIGS. 6 and 7 are graphs showing time domain radiation signals of the antenna device of FIG. 1.
Figure 7:
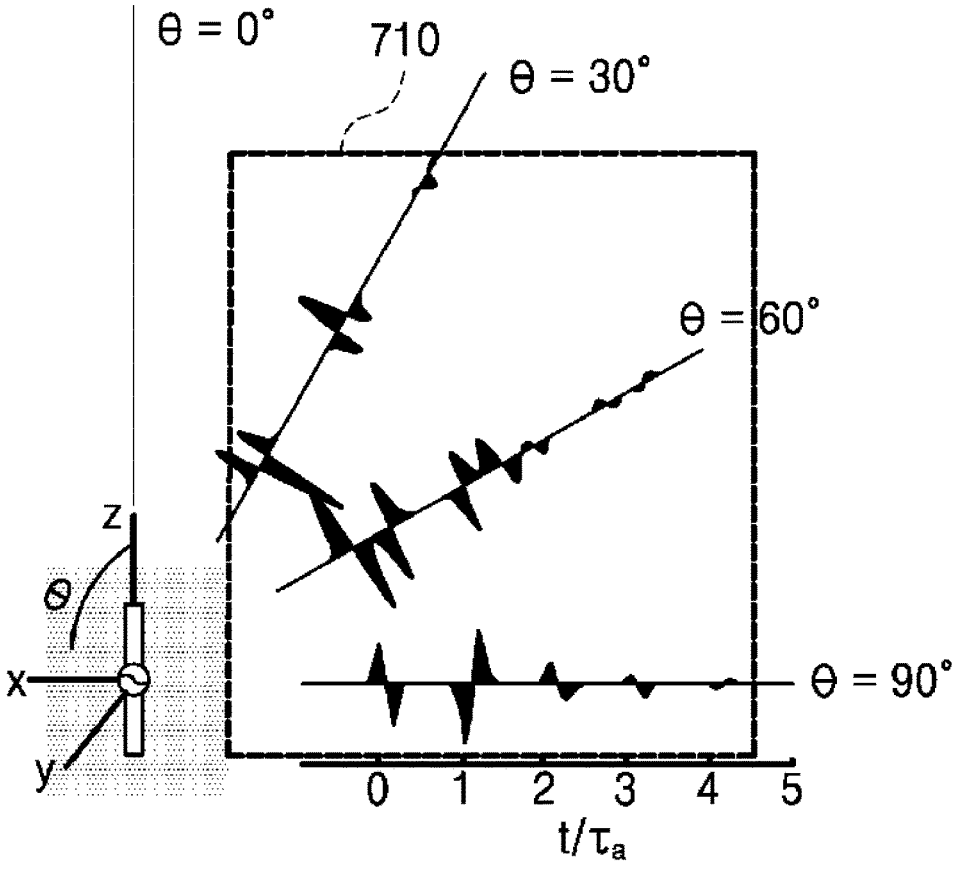

FIGS. 4 and 5 are views explaining the temporal changes of radiation amounts of the antenna device of FIG. 1 and a general antenna device that operates in a resonance mode, and FIGS. 6 and 7 are graphs showing time domain radiation signals of the antenna device of FIG. 1 and a general antenna device that operates in a resonance mode.

FIG. 4 shows propagation of a radiated signal with the lapse of time when the antenna device 100 according to the present disclosure radiates a signal, and FIG. 6 shows time domain waveforms of a radiated signal in accordance with the change of an elevation angle when the antenna device 100 according to the present disclosure radiates a signal.

FIG. 5 shows propagation of a radiated signal with the lapse of time when a general antenna device 100 that operates in a resonance mode radiates a signal, and FIG. 7 shows time domain waveforms of a radiated signal in accordance with the change of an elevation angle when a general antenna device 100 that operates in a resonance mode radiates a signal.

The antenna device 100 according to the present disclosure radiates a signal in a direction at an elevation angle of 0° to 360°, and it may be considered that the time domain waveforms of the radiated signals at respective elevation angles are symmetrical with the time domain waveforms in a direction of 0° to 90°. That is, in FIG. 6, the time domain waveforms in the direction of 30° are equal to the time domain waveforms in the directions of 150°, 210° and 330°.

In FIG. 4, a signal that is initially applied at a drive point propagates along the slot arm with a circular wave surface (410). With the lapse of time, the size of the circular wave surface becomes gradually larger, and the power of the applied signal is consumed by the resistors loaded in the slot to cause the signal strength to be gradually weakened (420). When the circular wave surface reaches the end of the slot, the weakened signal propagates as it is without being reflected (430).

That is, in the antenna, since the radiation (610) occurs only on the feeding portion as shown in FIG. 6, additional radiated signal does not exist, and thus the signal has the time domain characteristic that is suitable to sensing.

In contrast, in the case of a general slot antenna that operates in a resonance mode, as shown in FIG. 5, a signal that is initially applied at a drive point propagates along the slot arm with a circular wave surface (510). With the lapse of time, the size of the circular wave surface becomes gradually larger, and in the case of the general slot antenna, there is no loaded resistor, and the strength of the signal is maintained without power consumption due to the resistor (520). When the circular wave surface reaches the end of the slot, the signal reflection occurs, a secondary circular wave surface is formed around the end of the slot, and the reflected waves that occur at the end of the slot returns to the drive point (530).

That is, in addition to the feeding portion of the antenna as shown in FIG. 7, the electromagnetic waves are continuously radiated (710) in a time period when the electromagnetic waves propagate the slot arm. In the case where a general slot antenna is used as the radar, it may be difficult to discriminate whether the radiated electromagnetic waves correspond to the signal that is reflected from the target or the signal that is reflected in the antenna, whereas in the case of the slot antenna of FIG. 1, the reflected signal that occurs inside the antenna can be effectively removed, and thus it becomes possible to accurately discriminate the signal that is reflected from the target to provide the characteristic suitable to sensing.

Figure 8:
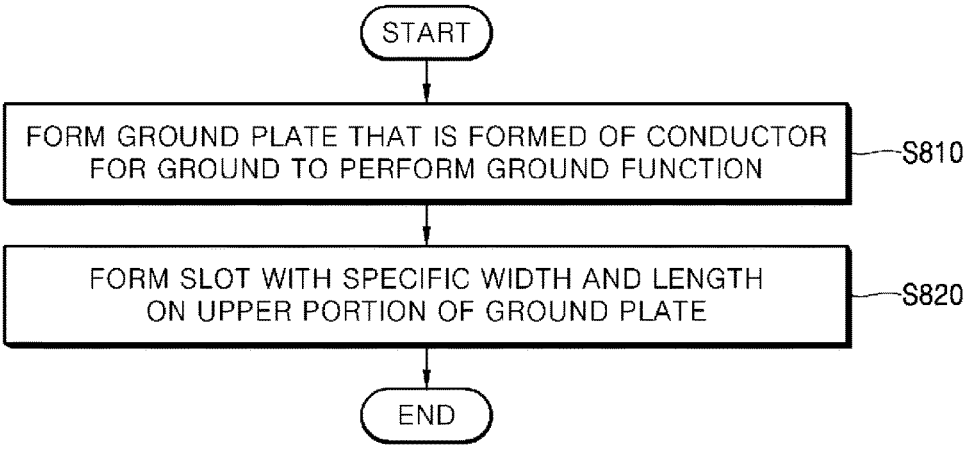
FIG. 8 is a flowchart explaining a method for manufacturing an antenna device according to an embodiment of the present disclosure.

FIG. 8 is a flowchart explaining a method for manufacturing an antenna device according to an embodiment of the present disclosure.

Referring to FIG. 8, a ground plate that is formed of a conductor for ground to perform ground function is formed (S810). A slot is formed with specific width and length on an upper portion of the ground plate (S820).

In an embodiment, s feeding portion to which a signal for feeding is applied is formed on a specific portion of the slot, and a plurality of chip resistors are formed apart from the feeding portion for a predetermined distance in a direction that crosses the width of the slot. Here, each of the plurality of chip resistors may have any one of a resistance value determined according to the position of the slot, a predetermined resistance value, and a resistance value determined according to an arrangement structure of the antenna device.

In an embodiment, the plurality of chip resistors may be formed at predetermined intervals in accordance with a resonance frequency according to specifications of the antenna device 100 (S820). In another embodiment, the plurality of chip resistors may be formed at predetermined intervals in accordance with the result of comparison of a resonance frequency generated between the feeding portion and the plurality of chip resistors with a resonance frequency according to the specifications of the antenna device 100 (S820). For example, the plurality of chip resistors may be formed at predetermined intervals so that the resonance frequency generated between the feeding portion and the plurality of chip resistors becomes higher than the resonance frequency according to the specifications of the antenna device.

INDUSTRIAL APPLICABILITY

The present disclosure can be used in an antenna device and a method for manufacturing the same as described above.

While the present disclosure has been described in connection with the specific embodiments illustrated in the drawings, they are merely illustrative, and the disclosure is not limited to these embodiments. It is to be understood that various equivalent modifications and variations of the embodiments can be made by a person having an ordinary skill in the art without departing from the spirit and scope of the present disclosure. Therefore, the true technical scope of the present disclosure should not be defined by the above-mentioned embodiments but should be defined by the appended claims and equivalents thereof.

What is claimed is:

1. A pulse radar antenna device that receives a pulse signal, radiates the same in a waveform in a space, and receives a returned signal, the pulse radar antenna device comprising:

a ground plate formed of a conductor for ground to perform ground function; and a slot formed with specific width and length and positioned on an upper portion of the ground plate, wherein the slot includes a feeding portion configured to receive a signal for feeding, a plurality of chip resistors positioned apart from the feeding portion for a predetermined distance in a direction that crosses the width of the slot, the ground plate has an absorption rate and an absorption loss rate according to specifications of the pulse radar antenna device, and the predetermined distance is determined so that a resonance frequency of the pulse signal generated between the feeding portion and the plurality of chip resistors becomes higher than that of the resonance frequency according to the specifications of the pulse radar antenna device through comparison of the resonance frequencies with each other.

2. The pulse radar antenna device of claim 1, wherein each of the plurality of chip resistors has any one of a resistance value determined according to the position of the slot, a predetermined resistance value, and a resistance value determined according to an arrangement structure of the pulse radar antenna device.

3. The pulse radar antenna device of claim 1, wherein each of the plurality of chip resistors consumes the power of the signal if the signal for feeding is applied to the feeding portion.

4. A method for manufacturing a pulse radar antenna device that receives a pulse signal, radiates the same in a waveform in a space, and receives a returned signal, the method comprising:

forming a ground plate of a conductor for ground to perform ground function;

forming a slot with a specific width and length on an upper portion of the ground plate, wherein the slot is formed including a feeding portion configured to receive a signal for feeding; and forming a plurality of chip resistors positioned apart from the feeding portion for a predetermined distance in a direction that crosses the width of the slot so that a resonance frequency of the pulse signal generated between the feeding portion and the plurality of chip resistors becomes higher than that of the resonance frequency according to the specifications of the pulse radar antenna device through comparison of the resonance frequencies with each other, wherein the ground plate has an absorption rate and an absorption loss rate according to specifications of the pulse radar antenna device.

5. The method of claim 4, wherein each of the plurality of chip resistors has any one of a resistance value determined according to the position of the slot, a predetermined resistance value, and a resistance value determined according to an arrangement structure of the pulse radar antenna device.

6. The method of claim 4, wherein each of the plurality of chip resistors consumes the power of the signal if the signal for feeding is applied to the feeding portion.

7. A pulse radar antenna device that receives a pulse signal, radiates the same in a waveform in a space, and receives a returned signal comprising:

a ground plate formed of a conductor for ground to perform ground function; and a slot formed with specific width and length and positioned on an upper portion of the ground plate, wherein the slot includes a feeding portion configured to receive a pulse signal for feeding and to radiate the pulse signal in a space, a plurality of chip resistors positioned apart from the feeding portion for a predetermined distance in a direction that crosses the width of the slot, the ground plate has an absorption rate and an absorption loss rate according to specifications of the pulse radar antenna device, and the predetermined distance is determined so that the radiated pulse signal occurs on the feeding portion and additional radiated pulse signals do not occur.

* * * * *